US009925645B2

(12) United States Patent
Song et al.

(10) Patent No.: US 9,925,645 B2
(45) Date of Patent: Mar. 27, 2018

(54) GRINDING TOOL

(71) Applicant: EHWA DIAMOND INDUSTRIAL CO., LTD., Osan-si, Gyeonggi-do (KR)

(72) Inventors: Young-Choul Song, Osan-si (KR); Sung-Hoon Chung, Irvine, CA (US); Jong-Suk Choi, Seoul (KR); Jae-Hyun Hong, Hwaseong-si (KR)

(73) Assignee: EHWA DIAMOND INDUSTRIAL CO., LTD., Osan-si (KR)

( * ) Notice: Subject to any disclaimer, the term of this patent is extended or adjusted under 35 U.S.C. 154(b) by 0 days.

(21) Appl. No.: 14/923,433

(22) Filed: Oct. 27, 2015

(65) Prior Publication Data

US 2016/0221155 A1 Aug. 4, 2016

(30) Foreign Application Priority Data

Feb. 2, 2015 (KR) ..... 10-2015-0015818

(51) Int. Cl.
*B24D 7/06* (2006.01)
*B24B 7/18* (2006.01)

(52) U.S. Cl.
CPC ..... *B24D 7/066* (2013.01); *B24B 7/18* (2013.01); *B24B 7/186* (2013.01)

(58) Field of Classification Search
CPC .. B24D 7/06; B24D 7/066; B24B 7/18; B24B 7/186; B24B 7/188
USPC ..... 451/353, 359, 548, 550
See application file for complete search history.

(56) References Cited

U.S. PATENT DOCUMENTS 2,425,368 A * 8/1947 Doermann ..... B24D 7/16 451/548
3,121,982 A * 2/1964 Miller ..... B24D 7/06 451/548
3,517,466 A * 6/1970 Bouvier ..... B24D 13/14 451/490
5,076,023 A * 12/1991 Saguchi ..... B24D 7/066 451/540
5,247,765 A * 9/1993 Quintana ..... B24D 7/063 451/548
5,567,503 A * 10/1996 Sexton ..... B24B 7/22 428/137

(Continued)

FOREIGN PATENT DOCUMENTS

JP 2004230522 A 8/2004
JP 2006068885 A 3/2006

(Continued)

OTHER PUBLICATIONS

Korean Notice of Allowance dated Sep. 15, 2015 in connection with the counterpart Korean Patent Application No. 10-2015-0015818.

*Primary Examiner* — Eileen Morgan
(74) *Attorney, Agent, or Firm* — Hauptman Ham, LLP

(57) ABSTRACT

Disclosed herein is a grinding tool, which includes a plate, a plurality of holders formed on the plate and having sliding grooves, a shoe coupled to the sliding groove of each of the holders, and grinding tips arranged on the shoe. The shoe includes a fastening part fastened to the sliding groove, and an upper plate part formed on the fastening part and located on an upper surface of the holder outside the sliding groove. The shoe can be fastened to the holder in two or more directions, and the grinding tips can be arranged in two or more forms when viewed from the plane.

7 Claims, 18 Drawing Sheets

(56) References Cited

U.S. PATENT DOCUMENTS

| | | | | | |
|---|---|---|---|---|---|
| 5,586,930 | A * | 12/1996 | Hayashi | B24B 7/22 | 451/548 |
| 6,196,911 | B1 * | 3/2001 | Preston | B24D 7/06 | 451/527 |
| 7,104,739 | B2 * | 9/2006 | Lagler | B27C 1/005 | 299/41.1 |
| 7,147,548 | B1 * | 12/2006 | Mehrabi | B24B 7/186 | 125/38 |
| 7,192,339 | B1 * | 3/2007 | Harding | B24B 7/186 | 451/350 |
| 7,506,644 | B2 * | 3/2009 | Park | B24D 7/066 | 125/22 |
| D612,874 | S * | 3/2010 | Nilsson | D15/138 | |
| 7,670,208 | B2 * | 3/2010 | Thysell | B24D 7/066 | 125/3 |
| 8,464,420 | B2 * | 6/2013 | Ye | B24B 7/186 | 29/244 |
| 2005/0164620 | A1 * | 7/2005 | Amamoto | B23C 5/006 | 451/548 |
| 2007/0254568 | A1 * | 11/2007 | Park | B24D 7/066 | 451/548 |
| 2007/0292207 | A1 * | 12/2007 | Reed | B24B 7/186 | 404/112 |

FOREIGN PATENT DOCUMENTS

| | | | |
|---|---|---|---|
| KR | 100816026 | B1 | 3/2008 |
| KR | 2020090001823 | U | 2/2009 |
| KR | 200473047 | Y1 | 6/2014 |

* cited by examiner (a)

(b)

(a)

(b)

GRINDING TOOL

CROSS-REFERENCE TO RELATED APPLICATION(S)

This application claims priority to Korean Patent Application No. 10-2015-0015818, filed on Feb. 2, 2015 in the Korean Intellectual Property Office, the disclosure(s) of which is(are) incorporated herein by reference in its(their) entirety.

BACKGROUND OF THE INVENTION

Field of the Invention

The present invention relates to a tool for grinding concrete, asphalt, marble, etc., and more particularly, to a grinding tool capable of adjusting cutting force, service life, dust, etc. in a single plate.

Description of the Related Art

In general, grinding tools are mainly used in the processes of grinding concrete, asphalt, artificial stone, natural stone, granite, marble, etc., or removing coating layers, etc., while rotating at high speed.

Grinding tools can be classified according to a structure in which a shoe having a grinding tip is directly fastened to a plate, a structure in which a shoe having a grinding tip is coupled to a holder in the state of fixing the holder to a plate, and the like.

Since the grinding tip formed in the shoe is gradually worn down according to the progress of grinding, it is necessary to replace the shoe at some point.

FIG. 1 is a view illustrating an example of a grinding tool in which shoes are coupled to a plate.

In FIG. 1, in order to couple shoes 5, in which grinding tips are arranged, to a plate 1 coupled to a drive unit through coupling holes 30, holders 5 are formed in the plate, and support pieces 4 formed in the shoes 2 are coupled to the plate 1.

The support pieces 4 are formed at both sides of each shoe 2, the plate 1 is formed with support piece coupling grooves 5 to which the support pieces 4 of the shoe 2 are coupled. In addition, a Velcro 3 is formed between the support piece coupling grooves 5 at a position corresponding to the inner surface of the shoe 2, such that a cushion is added and adhered to the shoe 2 with a rubber pad interposed therebetween.

In the case illustrated in FIG. 1, the shoes may be fastened to the plate only in one direction. As a result, all the grinding tips are arranged in a regular pattern, as illustrated in FIG. 1.

Besides, in the case where shoes having grinding tips are directly fastened to a plate, the shoes are fastened to the plate only in one direction. That is, all fronts of the grinding tips have a single shape when each shoe is viewed from the center of the plate in the state in which the shoes having the grinding tips are fastened to the plate.

FIG. 2 is a view illustrating an example in which grinding tips are arranged on a shoe. Herein, (a) of FIG. 2 illustrates the state in which the grinding tips are close to each other in the forward rotation direction, and (b) of FIG. 2 illustrates the state in which the grinding tips are spaced apart from each other in the forward rotation direction.

In FIG. 2, the grinding tips are arranged such that a grinding tip 20*a* located outward on the shoe forms an angle of approximately 20 to 60° with a grinding tip 20*b* located inward on the shoe. In the arrangement of the grinding tips illustrated in FIG. 2, the grinding tips have a long life due to an outside large area on the shoe, and have effects of collecting dust (see (a) of FIG. 2) and of raising dust (see (b) of FIG. 2) when the plate rotates.

FIG. 3 is a view illustrating another example in which grinding tips are arranged in almost parallel with each other on a shoe. In (a) of FIG. 3, the outside sides of the grinding tips are located further forward than the inside sides thereof in the rotation direction. However, (b) of FIG. 3 illustrates a case opposite to the above state.

In FIG. 3, the grinding tips are provided such that grinding tips 20*c* and 20*d*, which are located at respective front and rear in the rotation direction of a plate, are arranged in almost parallel with each other. In the arrangement of the grinding tips illustrated in FIG. 3, the grinding tips have high cutting force.

Only one grinding tip is typically arranged in one plate. However, in order to realize various arrangements of the grinding tips in one plate as illustrated in (a) and (b) of FIG. 2, and (a) and (b) of FIG. 3, the grinding tips have to be arranged in different forms on the shoe. For this reason, productivity is deteriorated.

As the related art, Korean Patent No. 10-0816026 (Mar. 21, 2008) discloses a grinding wheel assembly of a dry grinder.

SUMMARY OF THE INVENTION

An object of the present invention is to provide a grinding tool in which a shoe having a grinding tip is fastened to a holder in various directions, thereby enabling the grinding tip to be arranged in various forms.

Another object of the present invention is to provide a holder-shoe assembly that is applicable to the above grinding tool.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the accompanying drawings.

In accordance with an aspect of the present invention, a grinding tool includes a plate, a plurality of holders formed on the plate and having sliding grooves, a shoe coupled to the sliding groove of each of the holders, and grinding tips arranged on the shoe, wherein the shoe includes a fastening part fastened to the sliding groove, and an upper plate part formed on the fastening part and located on an upper surface of the holder outside the sliding groove, and a widthwise length of the fastening part is smaller than a width of an inlet of the sliding groove at an angle of 0° formed by a center line of the sliding groove and one predetermined center line of the fastening part of the shoe, and the widthwise length of the fastening part is smaller than the width of the inlet of the sliding groove at one or more of angles greater than 0° and less than 360° formed by the center line of the sliding groove and one predetermined center line of the fastening part, so that the shoe is fastened to the holder in two or more directions, and the grinding tips are arranged in two or more forms when viewed from the plane.

The sliding groove may have a shape in which a width thereof is narrowed as the sliding groove is directed upward, such that a width of the uppermost portion of the sliding groove is smaller than a widthwise length of the lowermost portion of the fastening part. In this case, the fastening part may have a shape in which the widthwise length thereof is narrowed as the fastening part is directed upward.

The uppermost portion of the sliding groove may be formed with a separation prevention protrusion protruding inward of the groove.

The sliding groove may have a shape in which a width thereof is narrowed as the sliding groove is away from the inlet, and thus the fastening part may be fitted to the sliding groove.

Each of the holders may be screwed and fixed to the plate.

The holder may further have a guide part formed outside the upper surface thereof.

In accordance with another aspect of the present invention, a grinding tool includes a plate, a plurality of holders formed on the plate and having sliding grooves, a shoe coupled to the sliding groove of each of the holders, and grinding tips arranged on the shoe, wherein the shoe includes a fastening part fastened to the sliding groove, and an upper plate part formed on the fastening part and located on an upper surface of the holder outside the sliding groove, the fastening part of the shoe has a cross-section in which a maximum width thereof is smaller than a width of an inlet of the sliding groove, so that the shoe is fastened to the holder in various directions, and the grinding tips are arranged in two or more forms when viewed from the plane, the sliding groove has a shape in which a width thereof is narrowed as the sliding groove is directed upward such that a width of the uppermost portion of the sliding groove is smaller than a width of the lowermost portion of the fastening part, or the uppermost portion of the sliding groove is formed with a separation prevention protrusion protruding inward of the groove, so that the shoe is prevented from being separated upward, and the sliding groove has a shape in which a width thereof is narrowed as the sliding groove is away from the inlet, and thus the fastening part is fitted to the sliding groove such that the shoe is prevented from being separated from the inlet.

In accordance with a further aspect of the present invention, a holder-shoe assembly for a grinding tool includes a holder having a sliding groove, and a shoe detachably coupled to the sliding groove of the holder, wherein the shoe includes a fastening part fastened to the sliding groove, and an upper plate part formed on the fastening part and located on an upper surface of the holder outside the sliding groove, and a widthwise length of the fastening part is smaller than a width of an inlet of the sliding groove at an angle of 0° formed by a center line of the sliding groove and one predetermined center line of the fastening part, and the widthwise length of the fastening part is smaller than the width of the inlet of the sliding groove at one or more of angles greater than 0° and less than 360° formed by the center line of the sliding groove and one predetermined center line of the fastening part, so that the shoe is fastened to the holder in two or more directions.

The sliding groove may have a shape in which a width thereof is narrowed as the sliding groove is directed upward, such that a width of the uppermost portion of the sliding groove is smaller than a widthwise length of the lowermost portion of the fastening part. In this case, the fastening part may have a shape in which the widthwise length thereof is narrowed as the fastening part is directed upward.

The uppermost portion of the sliding groove may be formed with a separation prevention protrusion protruding inward of the groove.

The sliding groove may have a shape in which a width thereof is narrowed as the sliding groove is away from the inlet, and thus the fastening part may be fitted to the sliding groove.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF EMBODIMENTS

Figure 1:
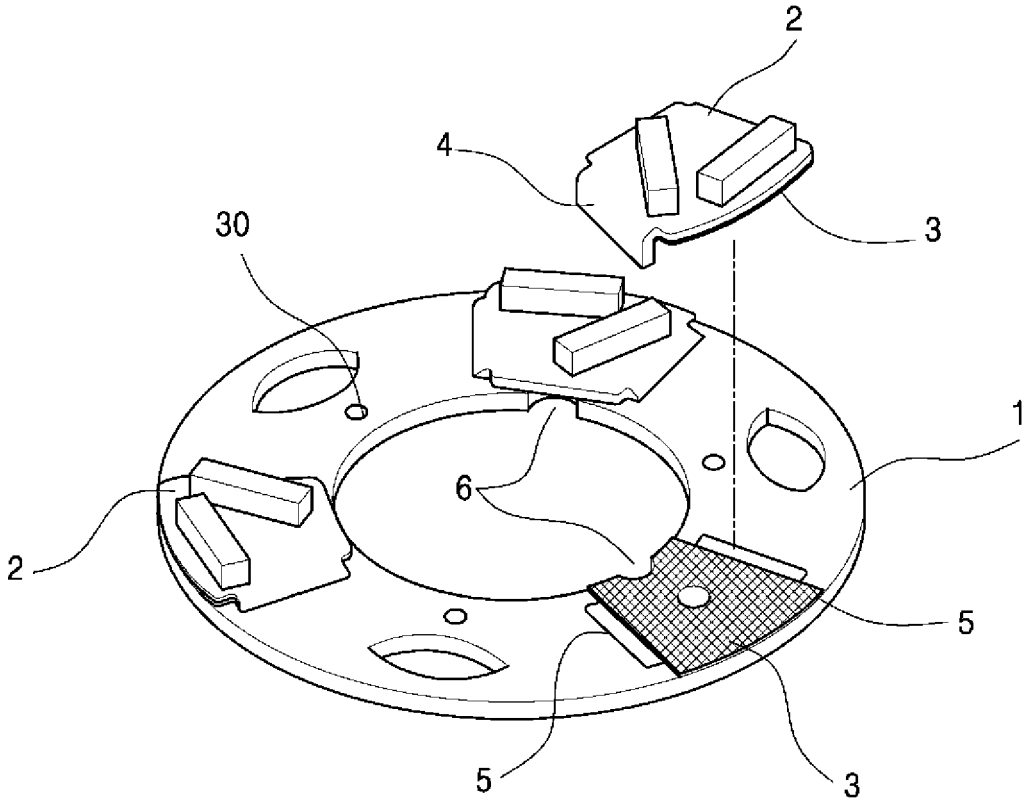
FIG. 1 is a view illustrating an example of a grinding tool in which shoes are coupled to a plate.
Figure 2:
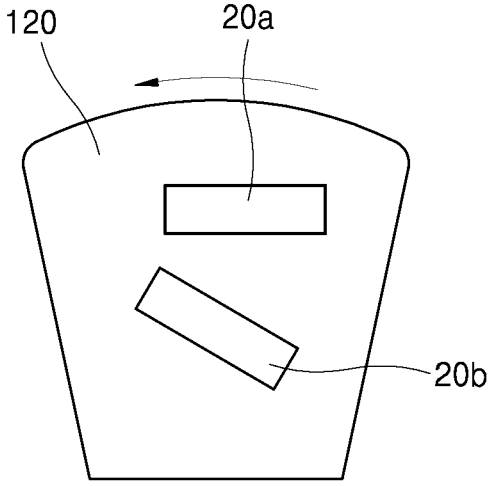
FIG. 2 is a view illustrating an example of the arrangement of grinding tips.
Figure 2:
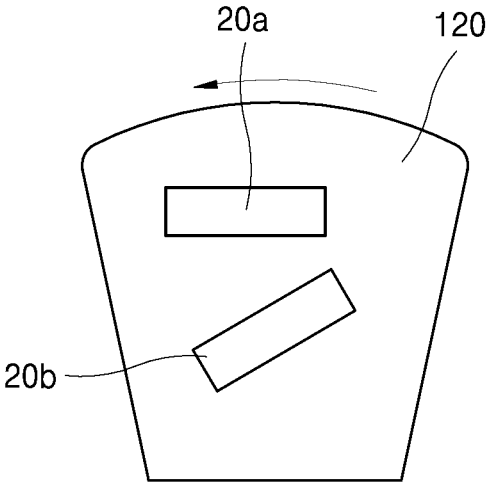
Figure 3:
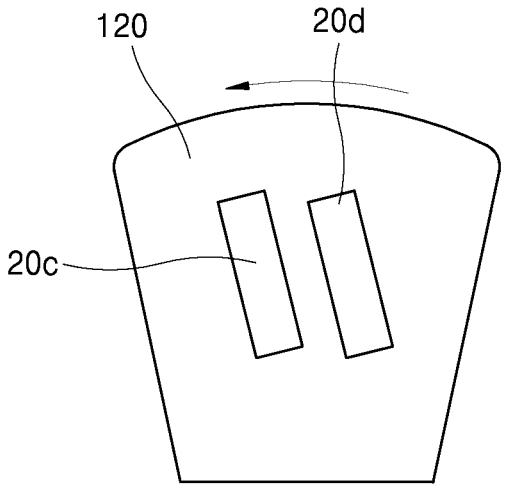
FIG. 3 is a view illustrating another example of the arrangement of grinding tips.
Figure 3:
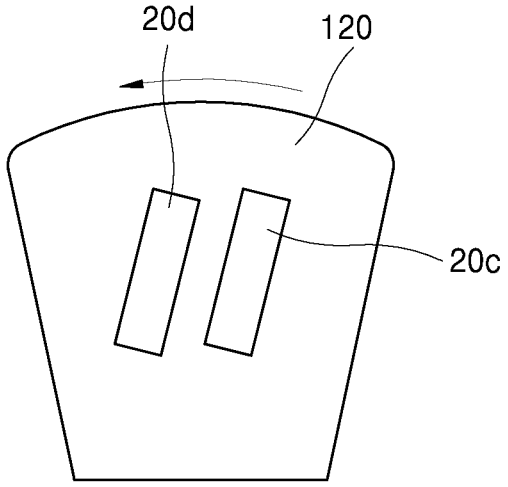

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Hereinafter, a grinding tool according to exemplary embodiments of the present invention will be described in detail with reference to the accompanying drawings.

Figure 4:
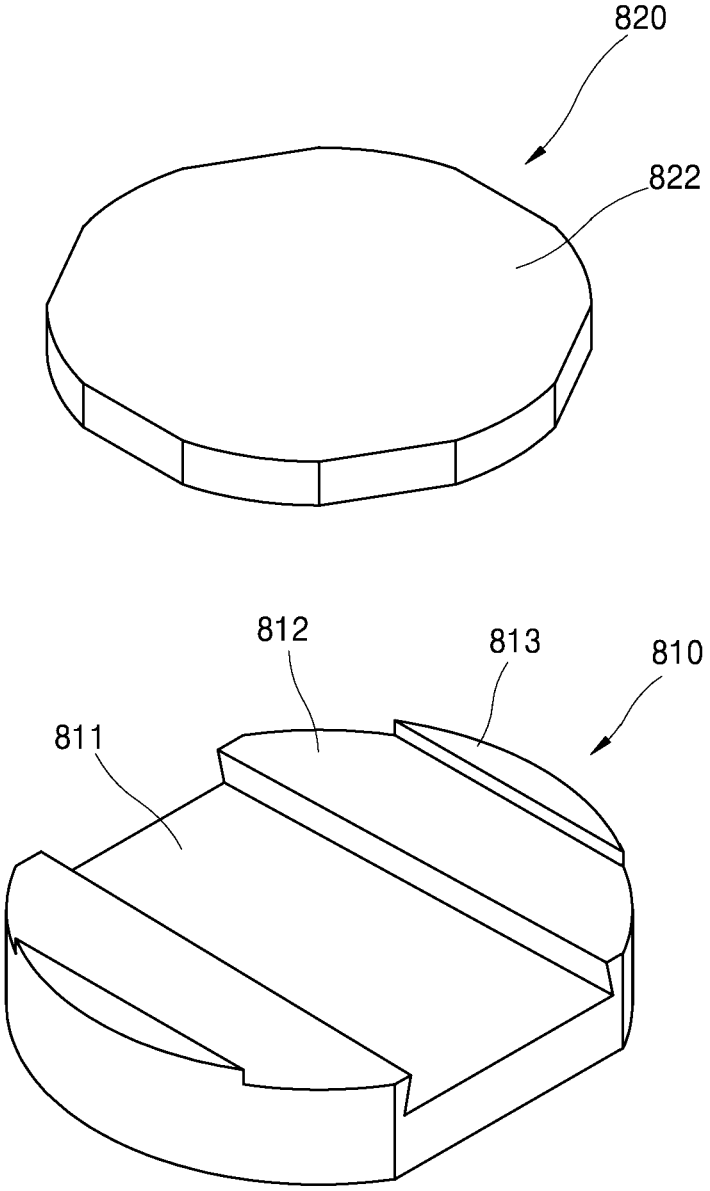
FIGS. 4 and 5 are perspective views illustrating an example of a holder and a shoe used in the present invention.
Figure 5:
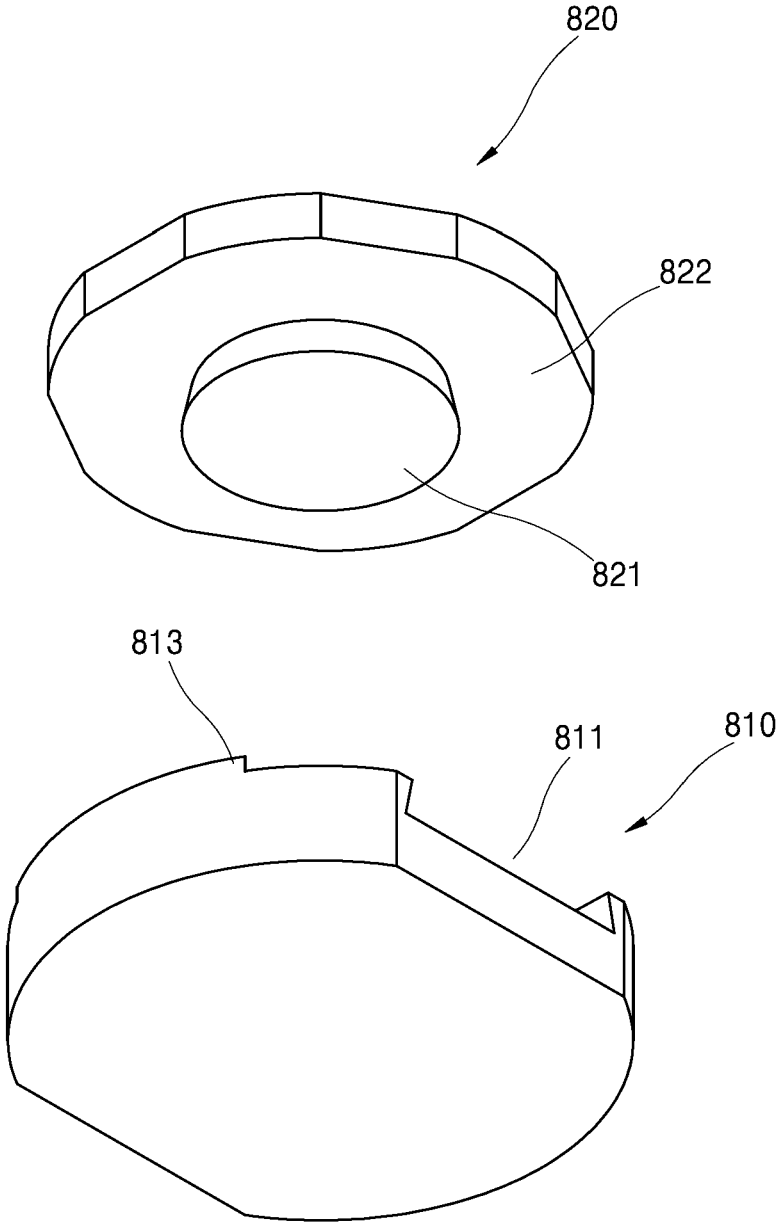
Figure 6:
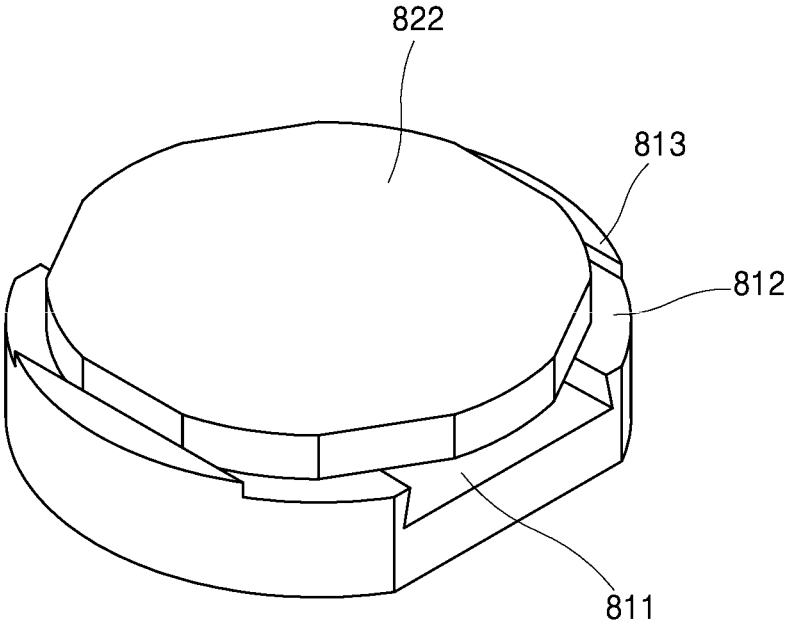
FIG. 6 is a perspective view illustrating an example of a holder-shoe assembly according to the present invention.
Figure 7:
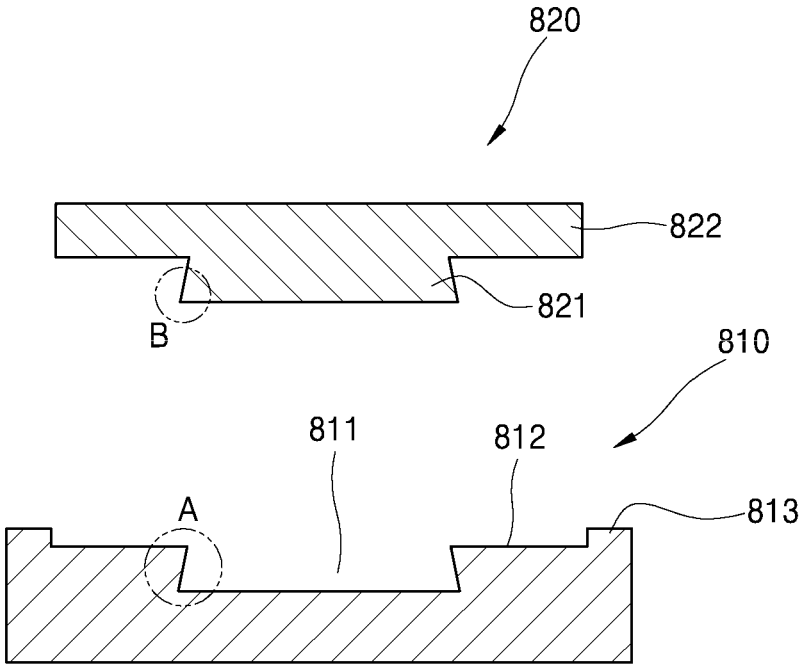
FIG. 7 is a cross-sectional view illustrating the example of the holder and the shoe used in the present invention.
Figure 8:
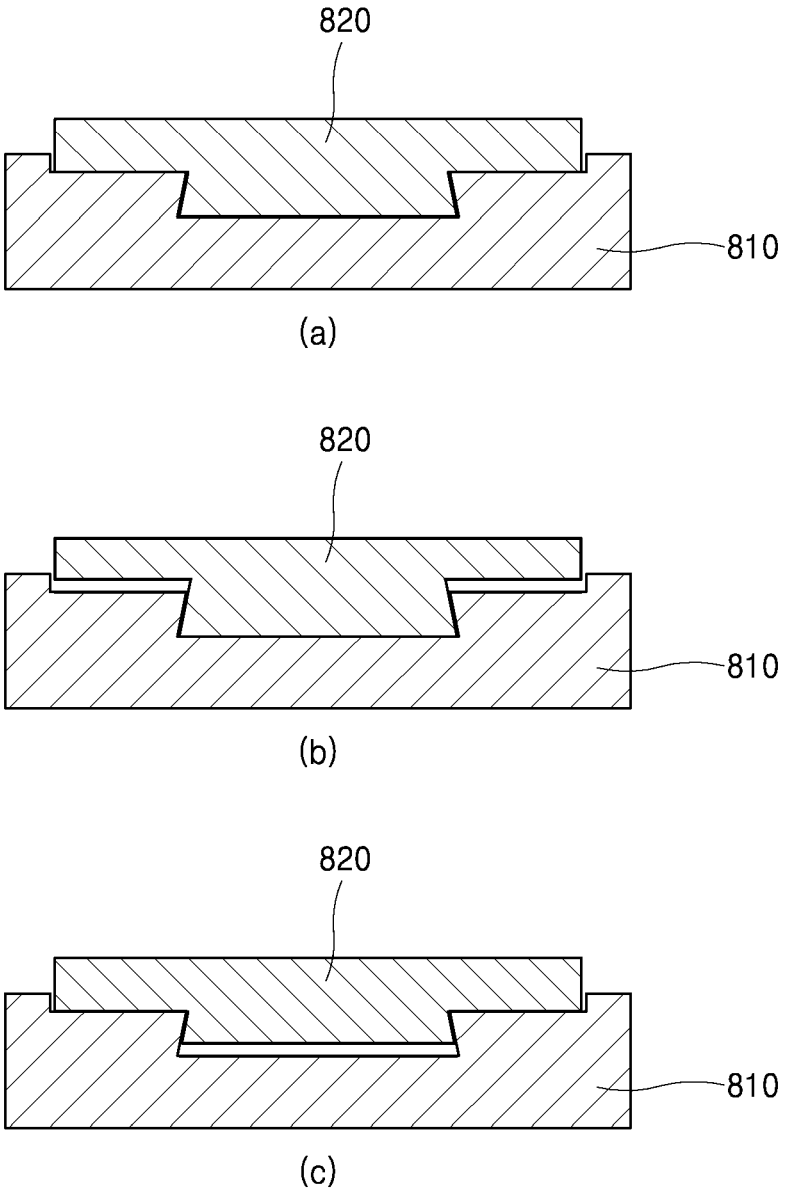
FIG. 8 is a cross-sectional view illustrating various examples of the holder-shoe assembly according to the present invention.

FIGS. 4 and 5 are perspective views illustrating an example of a holder and a shoe used in the present invention. FIG. 6 is a perspective view illustrating an example of a holder-shoe assembly according to the present invention. FIG. 7 is a cross-sectional view illustrating the example of the holder and the shoe used in the present invention. FIG. 8 is a cross-sectional view illustrating various examples of the holder-shoe assembly according to the present invention.

Referring to FIGS. 4 to 8, the holder-shoe assembly for a grinding tool according to the present invention includes a holder 810 and a shoe 820.

The holder 810 is a part formed on a plate in a grinding tool. The holder 810 may be fixed to the plate by screws, welding, etc. Alternatively, the holder may be formed integrally to the plate by plate machining.

The holder 810 has a sliding groove 811 so as to be coupled with the shoe 820. In addition, a holder upper surface 812 is formed outside the sliding groove 811.

In addition, a guide part 813 for guiding a shoe upper plate part 822 may be formed outside the holder upper surface 812. In this case, a portion of the widthwise lengths of the shoe upper plate part 822 is preferably greater than the width of the guide part such that the shoe upper plate part is restricted from being rotated by the guide part. The guide part 813 is more useful in the presence of a possibility that a shoe fastening part 821 has a circular cross-section and rotates.

Figure 11:
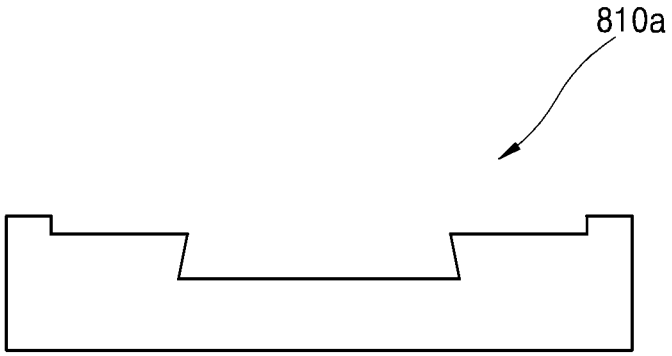
FIG. 11 is a cross-sectional view illustrating another example of the holder.

Meanwhile, a holder 810*a* without having the guide part may be used as illustrated in FIG. 11.

The shoe 820 is detachably coupled to the sliding groove 811 of the holder.

In this case, the shoe 820 includes a fastening part 821 and an upper plate part 822.

The fastening part 821 is a part fastened to the sliding groove 811 of the holder.

The shoe fastening part 821 has the substantially same height as the sliding groove 811 of the holder, but the present invention is not limited thereto. For example, the height of the shoe fastening part 821 may be greater than that of the sliding groove 811 of the holder.

The upper plate part 822 is formed on the fastening part 821, and is located on the holder upper surface 812 formed outside the sliding groove. As illustrated in (a) of FIG. 8, the upper plate part 822 may be seated on the holder upper surface 812, and the lower surface of the fastening part 821 may be seated on the sliding groove, but the present invention is not limited thereto. Alternatively, the upper plate part 822 may be slightly spaced apart from the holder upper surface 812, as illustrated in (b) of FIG. 8. Alternatively, the lower surface of the fastening part 821 may be slightly spaced apart from the sliding groove, as illustrated in (c) of FIG. 8.

Figure 12:
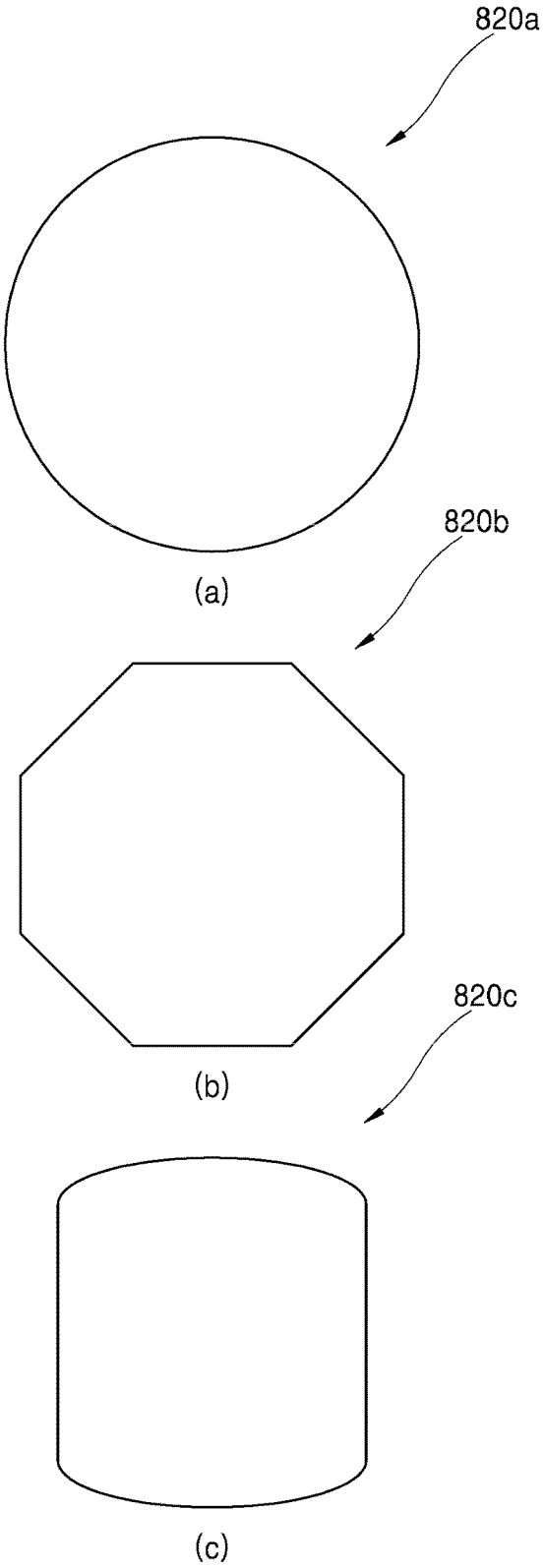
FIG. 12 is a top view illustrating various examples of a shoe upper plate part.

FIG. 12 is a top view illustrating other examples of the shoe upper plate part.

An example in which the upper plate part has a circular plane is illustrated in (a) of FIG. 12. An example in which the upper plate part has an octagonal plane is illustrated in (b) of FIG. 12. An example in which the upper plate part has a plane of straight lines and curves is illustrated in (c) of FIG. 12.

As illustrated in FIG. 4 or 12, the upper plate part may have various shapes such as a circular shape, a polygonal shape, and a shape of straight lines and curves.

In the shoe 820, the fastening part 821 may be bonded to the upper plate part 822 by welding, or may be integral with the upper plate part 822.

In the holder-shoe assembly for a grinding tool according to the present invention, the widthwise length of the fastening part is smaller than the width of the inlet of the sliding groove at an angle of 0° formed by the center line of the sliding groove of the holder and one predetermined center line of the shoe fastening part, and thus the shoe may be fastened to the holder. In this case, the widthwise length of the fastening part is also smaller than the width of the inlet of the sliding groove at one or more of angles which are greater than 0° and less than 360° formed by the center line of the sliding groove and one predetermined center line of the fastening part, and therefore the shoe may be fastened to the holder even in such a direction. That is, in the holder-shoe assembly for a grinding tool according to the present invention, the shoe may be fastened to the holder in two or more directions.

Figure 14:
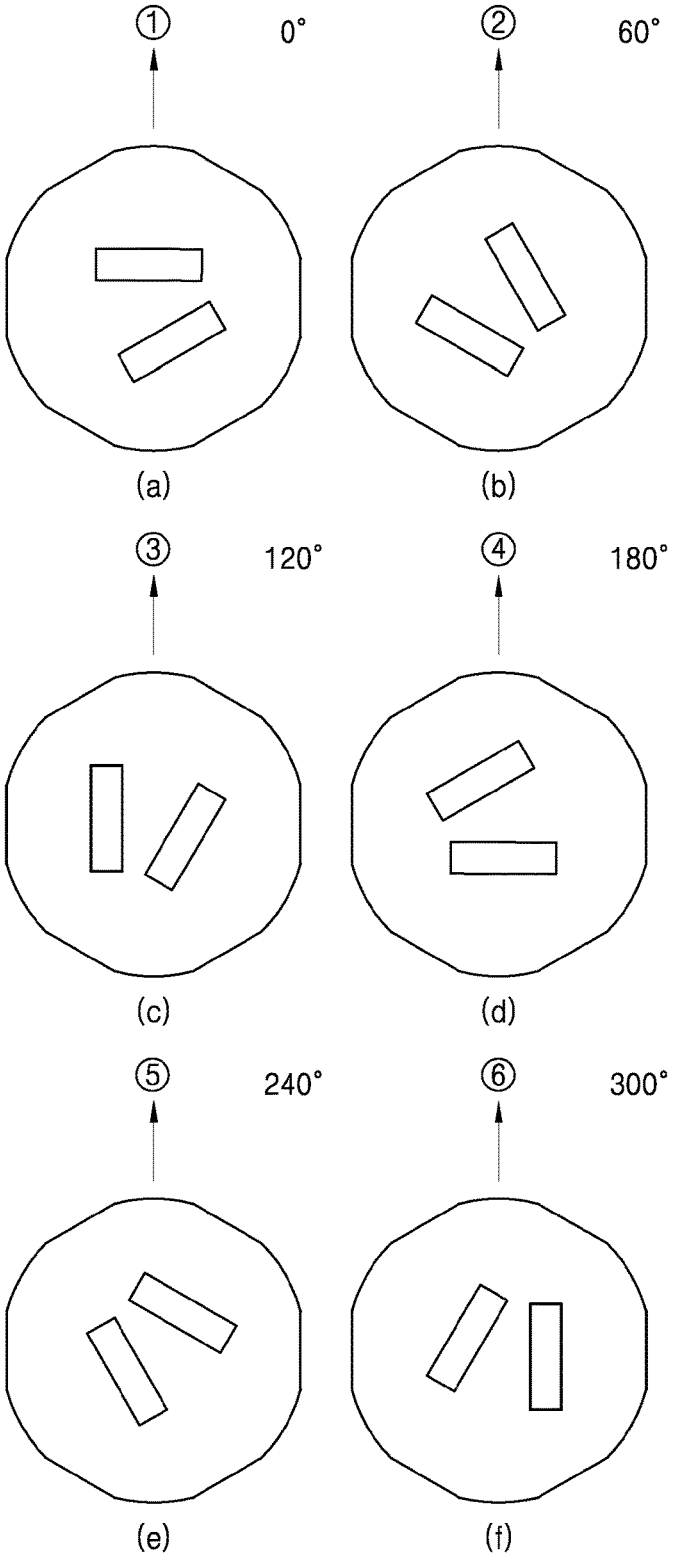
FIG. 14 is a view illustrating a state in which a shoe having grinding tips arranged in a specific pattern is coupled in six directions.

In this case, even when grinding tips are arranged on the shoe in a single pattern, the grinding tips may be arranged in various forms, for example according to the fastening directions (①, ②, ③, ④, ⑤, and ⑥) of the shoe illustrated in (a) to (f) of FIG. 14. Therefore, cutting force, dust, and the like can be controlled during grinding. FIG. 14 illustrates that the grinding tips are arranged on the shoe in a single pattern. Herein, (b) to (f) of FIG. 14 illustrate that the shoe is fastened to the holder in the state in which it is rotated 60° (see (b) of FIG. 14), 120° (see (c) of FIG. 14), 180° (see (d) of FIG. 14), 240° (see (e) of FIG. 14), and 300° (see (f) of FIG. 14), respectively, on the basis of the angle illustrated in (a) of FIG. 14. This may be similarly applied to the pattern of FIG. 16 different from that of FIG. 14.

Figure 17:
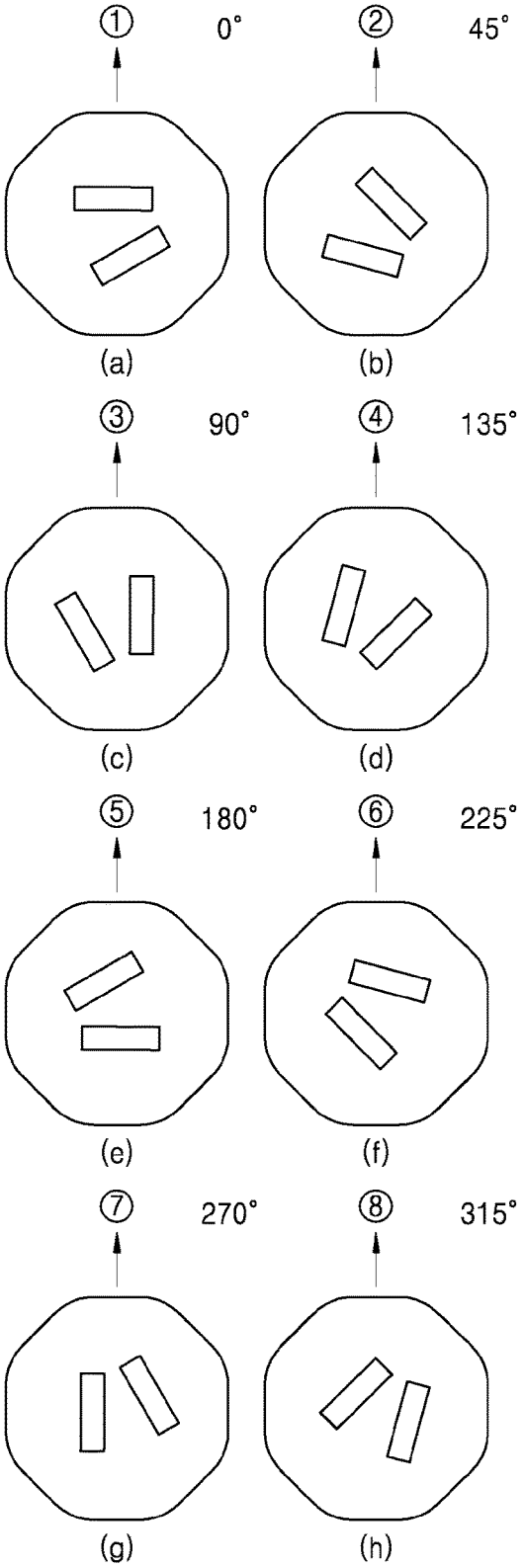
FIG. 17 is a view illustrating a state in which a shoe having grinding tips arranged in a specific pattern is coupled in eight directions.

FIG. 17 is a view illustrating a state in which a shoe having grinding tips arranged in a specific pattern is coupled in eight directions. The grinding tips may be arranged in various forms according to the fastening directions (①, ②, ③, ④, ⑤, ⑥, ⑦, and ⑧) of the shoe illustrated in (a) to (h) of FIG. 17. FIG. 17 illustrates that the grinding tips are arranged on the shoe in a single pattern. Herein, (b) to (h) of FIG. 17 illustrate that the shoe is fastened to the holder in the state in which it is rotated 45° (see (b) of FIG. 17), 90° (see (c) of FIG. 17), 135° (see (d) of FIG. 17), 180° (see (e) of FIG. 17), 225° (see (f) of FIG. 17), 270° (see (g) of FIG. 17), and 315° (see (h) of FIG. 17), respectively, on the basis of the angle illustrated in (a) of FIG. 17. This may be similarly applied to the pattern of FIG. 18 different from that of FIG. 17.

The shoe fastening part may have a small cross-section in which the widthwise length of the fastening part is smaller than the width of the inlet of the sliding groove in all directions. That is, the shoe fastening part may have a small cross-section in which the maximum width of the shoe fastening part is smaller than the width of the inlet of the sliding groove. As illustrated in FIG. 5, it is more preferable that the fastening part have a circular cross-section in which the diameter thereof is smaller than the width of the inlet of the sliding groove.

Figure 13:
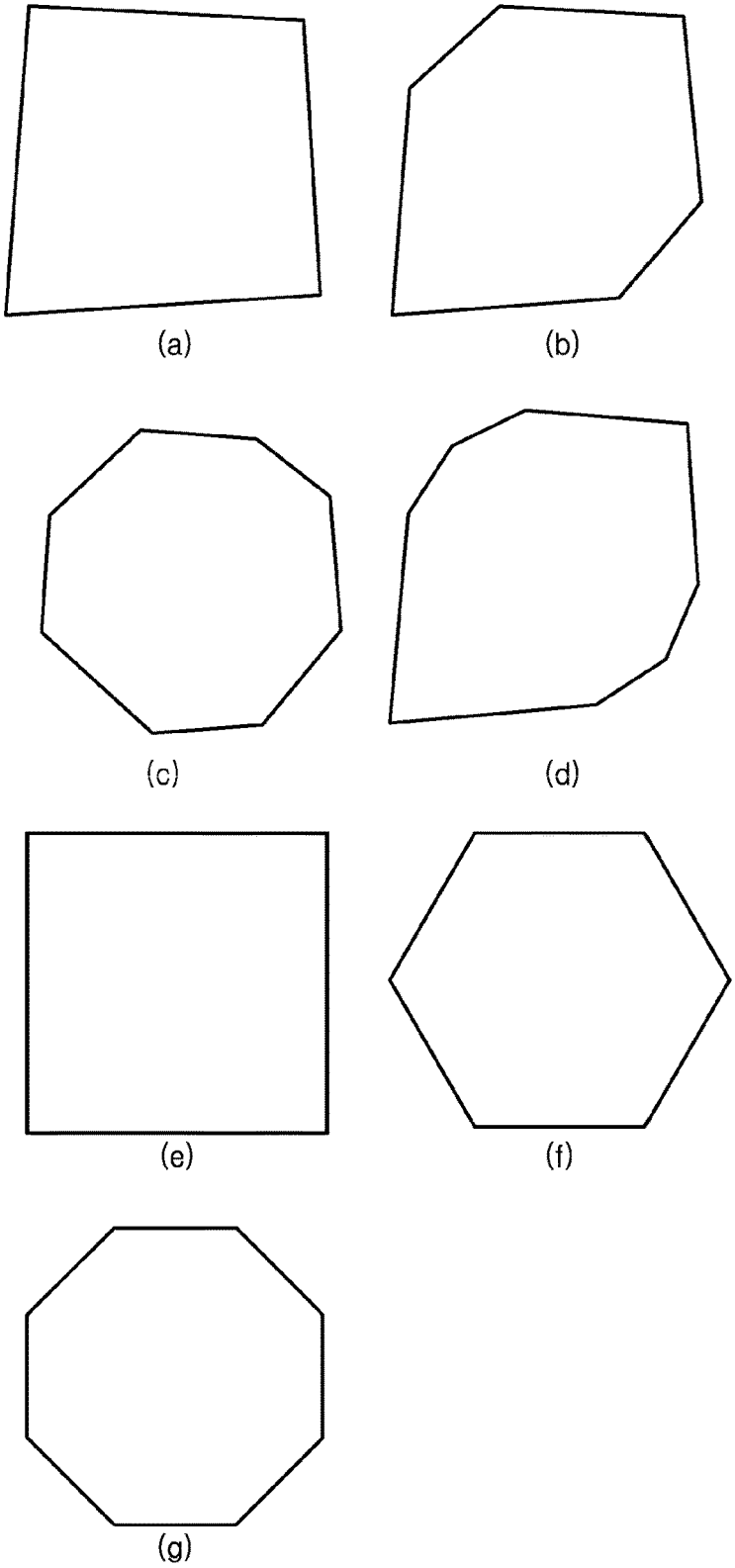
FIG. 13 is a cross-sectional view illustrating various examples of a shoe fastening part.

In addition to the above configuration, the shoe fastening part may have various cross-sections such as a polygonal shape, an elliptical shape, and a shape of straight lines and curves, as illustrated in (a) to (g) of FIG. 13. For example, the shoe fastening part may have a regular polygonal shape as illustrated in (e) to (g) of FIG. 13. In addition, the shoe fastening part may have a shape in which the width thereof is narrowed in a specific direction, as illustrated in (a) to (d) of FIG. 13. When the shoe fastening part has a shape in which the width thereof is narrowed in a specific direction, the shoe fastening part is fitted to the sliding groove having a shape in which the width thereof is narrowed as the groove is away from the inlet thereof as described to be later, thereby enabling the coupled fitting area therebetween to be increased. Consequently, the shoe fastening part can be more securely fastened to the sliding groove.

Meanwhile, as illustrated in FIGS. 7 and 8, the sliding groove preferably has a shape (see portion "A" of FIG. 7) in which the width thereof is narrowed as the groove is directed upward, such that the width of the uppermost portion of the sliding groove is smaller than the widthwise length of the lowermost portion of the shoe fastening part. Through such a configuration, the holder can be prevented from being separated upward. In this case, the fastening part may also have a shape (see portion "B" of FIG. 7) in which the widthwise length thereof is narrowed as the fastening part is directed upward.

Figure 9:
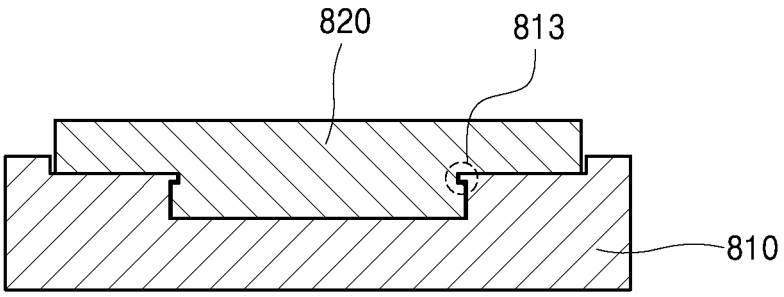
FIG. 9 is a cross-sectional view illustrating another example of the holder-shoe assembly according to the present invention.

As an alternative example, a separation prevention protrusion 813 may be formed at the uppermost portion of the sliding groove so as to protrude inward of the sliding groove, as illustrated in FIG. 9.

Figure 10:
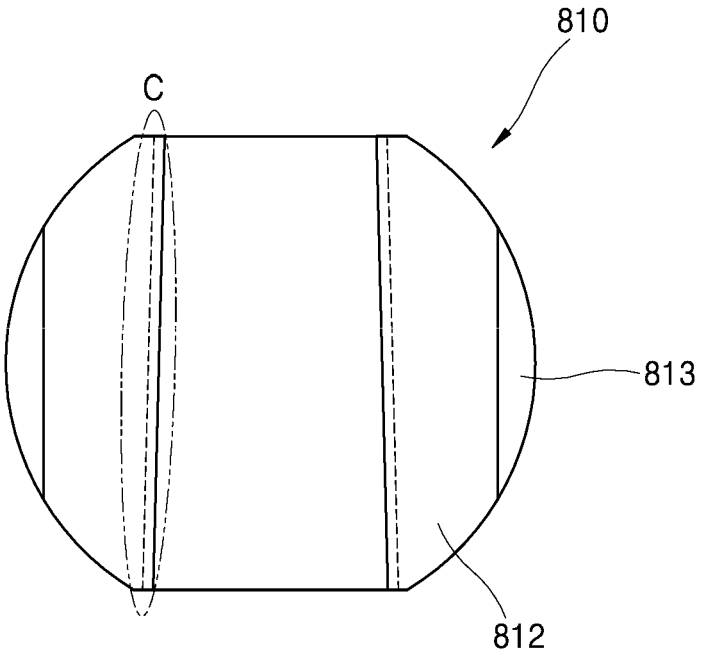
FIG. 10 is a view illustrating a state in which the width of a sliding groove becomes small as the sliding groove is away from an inlet thereof.

In addition, it is preferable that the sliding groove have a shape in which the width thereof is narrowed as it is away from the inlet thereof, so that the shoe fastening part is fitted to the sliding groove, as portion "C" illustrated in FIG. 10. Through such a configuration, the holder can be prevented from being separated from the inlet of the sliding groove.

Figure 15:
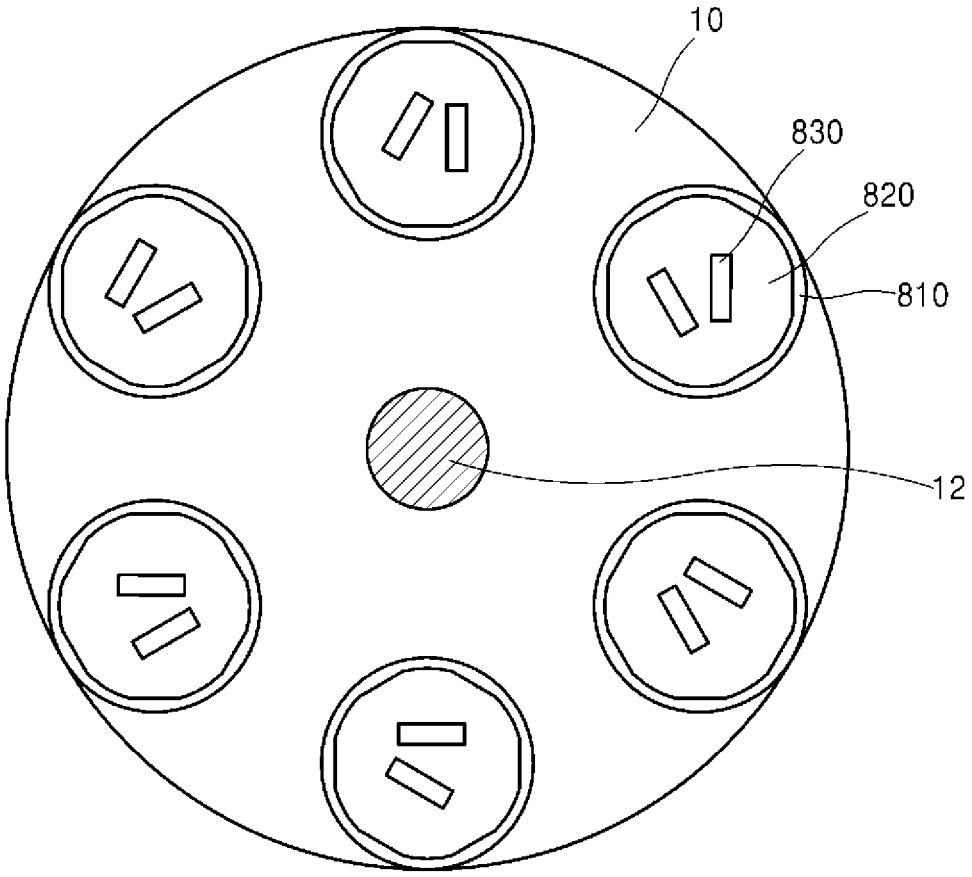
FIG. 15 is a view illustrating a grinding tool according to an embodiment of the present invention.

FIG. 15 is a view illustrating a grinding tool according to an embodiment of the present invention.

Referring to FIG. 15, the grinding tool includes a plate 10, holders 810, shoes 820, and grinding tips 830.

The plate 10 includes a coupling portion 12 for allowing the plate 10 to be coupled to a drive unit. The coupling portion 12 may have various shapes, and may be determined according to the shape of a coupling portion formed at the drive unit. In addition, the plate 10 may have thread grooves through which a plurality of holders 810 may be fixed.

The holders 810 are fixed to the plate 10, and have sliding grooves. The holders 810 may be screwed to the plate 10.

The shoes 820 are detachably coupled to the sliding grooves.

The grinding tips 830 are made of diamond abrasive, cemented carbide, or the like, and are arranged on the shoes 820.

As described above, each of the shoes includes a fastening part which is fastened to the associated sliding groove, and an upper plate part which is formed on the fastening part and is located on the upper surface of the holder outside the sliding groove. The widthwise length of the fastening part is smaller than the width of the inlet of the sliding groove at an angle of 0° formed by the center line of the sliding groove and one predetermined center line of the shoe fastening part, and the widthwise length of the fastening part is also smaller than the width of the inlet of the sliding groove at one or more of angles which are greater than 0° and less than 360° formed by the center line of the sliding groove and one predetermined center line of the fastening part. Therefore, the shoe may be fastened to the holder in two or more directions.

Figure 16:
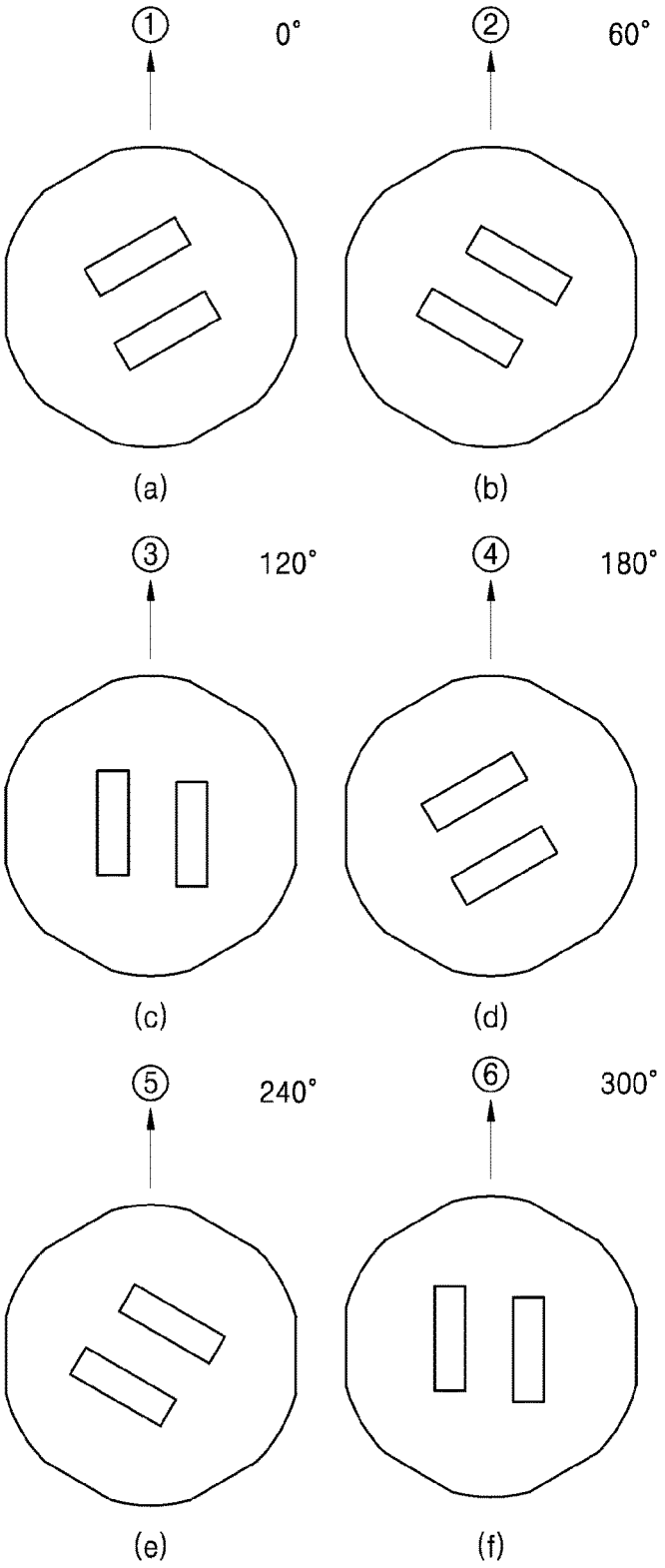
FIG. 16 is a view illustrating a state in which a shoe having grinding tips arranged in another pattern is coupled in six directions.
Figure 18:
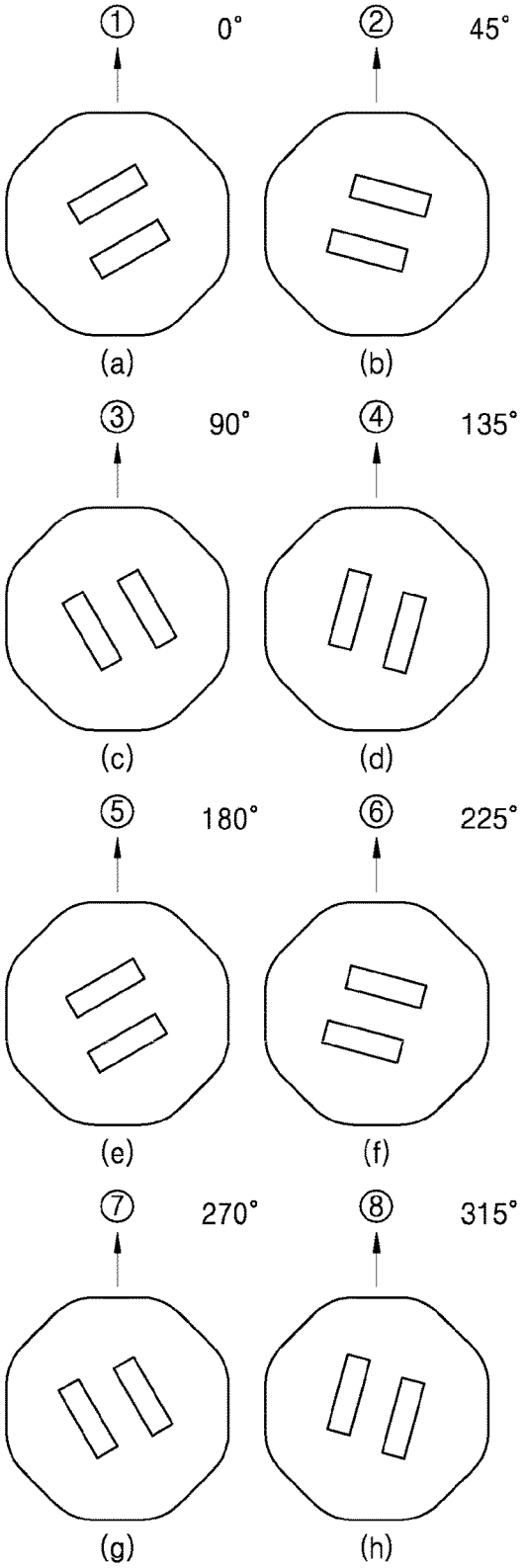
FIG. 18 is a view illustrating a state in which a shoe having grinding tips arranged in another pattern is coupled in eight directions.

Meanwhile, the guide part is formed at the holder and the shoe is prevented from being rotated by the guide part, as illustrated in FIGS. 4 to 6. In this case, the shoe upper plate parts may be coupled to the holders in six directions, as illustrated in FIGS. 14 and 16, and the shoe upper plate parts may be coupled to the holders in eight directions, as illustrated in FIGS. 17 and 18. That is, in these examples, the shoes may be fastened to the holders in many directions. As a result, it may be identified that the arrangements of the grinding tips slightly vary according to the fastening directions of the shoes when viewed from the plane.

The description has been given above in which the shoes are fitted to the holders in various directions, and various characteristics are realized through variation in arrangements of the grinding tips. This technical spirit may be applied to the case when the shoes are directly coupled to the plate.

As described above, in the grinding tool according to the present invention, since the shoes having the grinding tips can be fastened to the holders or the plate in various directions, the grinding tips can be arranged in various forms on the single plate. Accordingly, in the grinding tool according to the present invention, the adjustment of cutting force, service life, and dust can be effectively controlled.

As is apparent from the above description, in accordance with the grinding tool, the shoe having the grinding tip can be fastened to the holder or the plate in various directions.

Accordingly, the grinding tip can be arranged in various forms on the single plate, and thus the adjustment of cutting force, service life, and dust can be effectively controlled.

Although the present invention has been described with respect to the illustrative embodiments, it will be apparent to those skilled in the art that various variations and modifications may be made without departing from the spirit and scope of the invention as defined in the following claims.

What is claimed is:

1. A grinding tool comprising:

a plate;

a plurality of holders formed on the plate and having sliding grooves;

a plurality of shoes, each shoe of the plurality of shoes coupled to a sliding groove of each corresponding holder among the plurality of holders, respectively; and grinding tips arranged on the plurality of the shoes, wherein two or more grinding tips are arranged on the each shoe of the plurality of shoes;

the each shoe of the plurality of shoes comprises a fastening part fastened to the sliding groove, and an upper plate part formed on the fastening part and facing an upper surface of the each corresponding holder outside the sliding groove; and a widthwise length of the fastening part is smaller than a width of an inlet of the sliding groove at an angle of 0° formed by a center line of the sliding groove and one predetermined center line of the fastening part of the each shoe, and the widthwise length of the fastening part is smaller than the width of the inlet of the sliding groove at two or more of angles greater than 0° and less than 360° formed by the center line of the sliding groove and the one predetermined center line of the fastening part, so that the each shoe is fastened to the each corresponding holder among the plurality of holders in three or more directions, and the two or more grinding tips arranged on the each shoe of the plurality of shoes are arranged in three or more forms when viewed from above.

2. The grinding tool according to claim 1, wherein the sliding groove of the each corresponding holder has a shape in which a width thereof is narrowed as the sliding groove is directed upward, such that a width of the uppermost portion of the sliding groove is smaller than a widthwise length of the lowermost portion of the fastening part.

3. The grinding tool according to claim 2, wherein the fastening part of the each shoe has a shape in which the widthwise length thereof is narrowed as the fastening part is directed upward.

4. The grinding tool according to claim 1, wherein the uppermost portion of the sliding groove of the each corresponding holder is formed with a separation prevention protrusion protruding inward of the sliding groove.

5. The grinding tool according to claim 1, wherein the sliding groove has a shape in which a width thereof is narrowed as the sliding groove is away from the inlet, and thus the fastening part is fitted to the sliding groove.

6. The grinding tool according to claim 1, wherein each holder of the plurality of holders is screwed and fixed to the plate.

7. The grinding tool according to claim 1, wherein each holder of the plurality of holders has a guide part formed outside the upper surface thereof.

* * * * *